United States Patent [19]

Stack

[11] Patent Number: 4,894,588

[45] Date of Patent: Jan. 16, 1990

[54] HIGH EFFICIENCY FLASHER

[75] Inventor: Thomas E. Stack, Troy, Mich.

[73] Assignee: Vultron, Inc., Auburn Heights, Mich.

[21] Appl. No.: 148,088

[22] Filed: Jan. 25, 1988

[51] Int. Cl.[4] ..... H05B 37/00

[52] U.S. Cl. ..... 315/241 P; 315/241 R; 315/315; 315/224; 315/DIG. 5

[58] Field of Search ..... 315/315, 241 R, 224, 315/307, 241 P, 209, DIG. 1, DIG. 4, DIG. 5, DIG. 7

[56] References Cited

U.S. PATENT DOCUMENTS

| | | | |
|---|---|---|---|
| 3,875,527 | 4/1975 | Garcia | 331/65 |
| 4,185,232 | 1/1980 | Ingalls et al. | 315/241 R |
| 4,464,609 | 8/1984 | Nakamura et al. | 315/241 P |
| 4,613,847 | 9/1986 | Scolari et al. | 340/114 R |
| 4,623,824 | 11/1986 | Scolari et al. | 315/241 P |

*Primary Examiner*—Leo H. Boudreau
*Assistant Examiner*—Michael Razavi
*Attorney, Agent, or Firm*—Reising, Ethington, Barnard, Perry & Milton

[57] ABSTRACT

A heavy duty flasher for incandescent lamps for a motor coach or the like incorporates a pair of power MOSFETs in parallel for efficient, cool operation and includes a pair of timers, one for flash rate control and the other for producing AC for operating a voltage multiplier to provide gate voltage for the MOSFETs. Protective circuitry senses current overload and terminates current flow to protect the power devices while allowing inrush current to the lamps at the beginning of each cycle. A circuit sensitive to the presence of load supplies power to the timers only under load conditions.

7 Claims, 1 Drawing Sheet

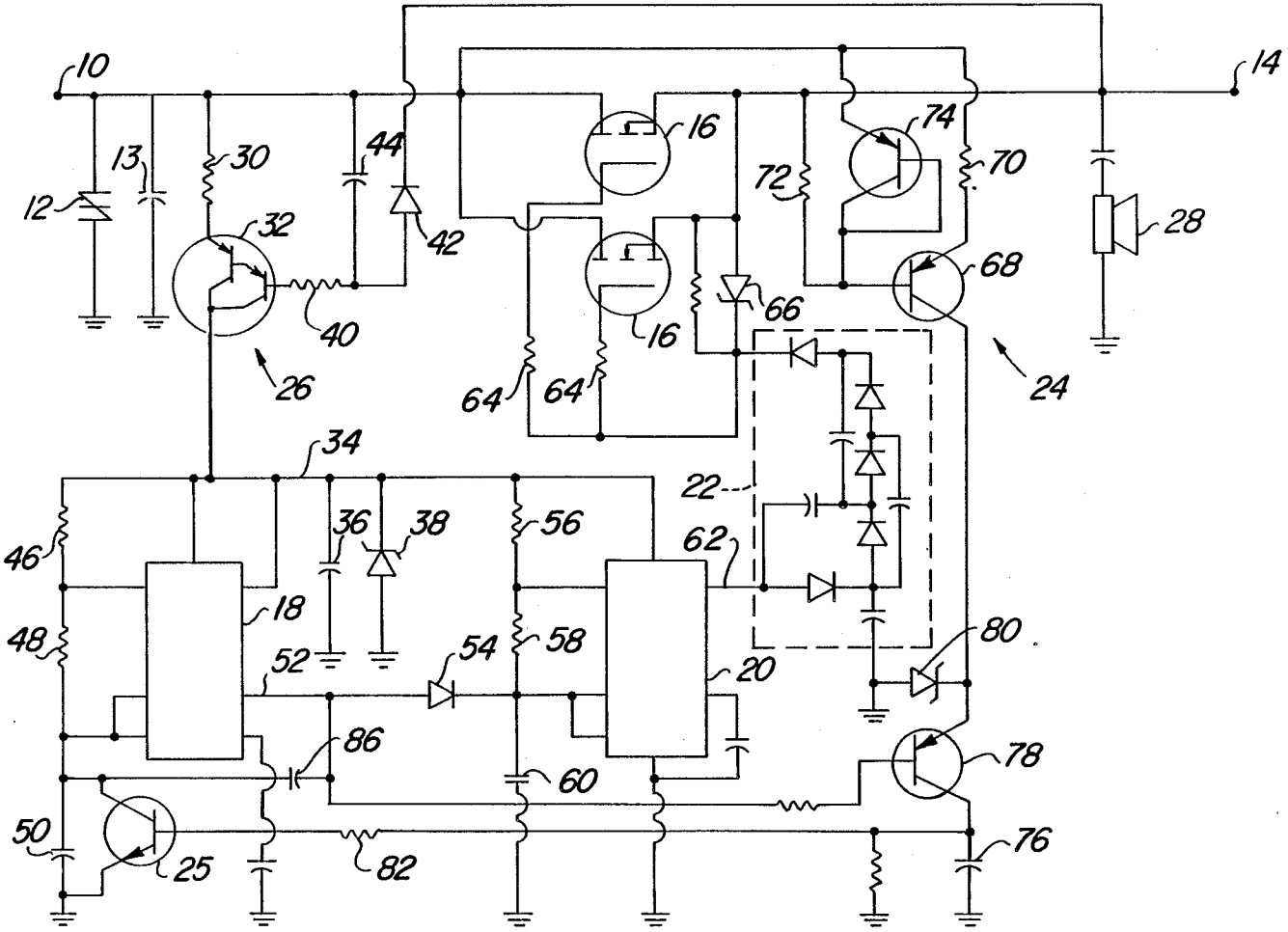
14
28
24
70
68
74
72
66
16
16
64
64
42
44
40
26
32
30
13
12
10
80
78
76
20
22
62
56
58
60
54
38
36
34
86
82
18
52
25
46
48
50

HIGH EFFICIENCY FLASHER

FIELD OF THE INVENTION

This invention relates to an electronic flasher for an automotive vehicle and particularly to such a flasher employing MOSFET (MOS field effect transistor) technology for high efficiency, high load operation.

BACKGROUND OF THE INVENTION

Traditionally the turn signal and emergency flasher controls for the incandescent warning lamps of automotive vehicles have employed electromechanical flashers to periodically turn the lamp current on and off to achieve flashing operation of the lamps, although it is also well known to use electronic oscillator circuits to achieve the same purpose. The characteristics of the application places certain demands on the circuit whether it switches by opening and closing mechanical contacts or by solid state switching. The incandescent lamp load has the characteristic of drawing large inrush current when the filaments are cold and their resistance is low and then decreasing to a steady state value when hot. The inrush current can reach ten times the steady state value. This cold filament phenomenon occurs for each cycle of the flasher. Thus, while the flasher circuit is ideally designed for the steady state value, it must accommodate the inrush current as well.

In the case of heavy duty applications, such as a motor coach having many lamps flashing simultaneously, a steady state lamp load of 20 amps is not uncommon and thus current inrush values of 200 amps are to be expected. Electromechanical flashers have been used for this purpose however the switch contacts are subject to erosion which eventually leads to flasher failure. To avoid that problem heavy duty electronic flashers have been proposed using bipolar power transistors which suffer large heat losses requiring large heat sinks. The heat sink for such flashers is so large that the flasher package is very much larger than the electromechanical flasher it is to replace and can not readily fit in the space of the replaced flasher. In addition the large heat output of the flasher is wasted electrical energy.

U.S. Pat. No. 3,875,527, in FIG. 6*b* discloses an oscillator having a MOSFET to control logic gates in the circuit and thus handles only signal level currents. The oscillator triggers a lamp circuit but does not handle lamp current directly.

U.S Pat. No. 4,185,232 shows a flash lamp operating circuit having a DC source, a DC to AC converter, and a voltage doubler to provide sufficiently high voltage for flash lamp discharge. The circuit also has an astable multivibrator for timing the flashes of the lamps.

U.S. Pat. No. 4,613,847 discloses a flash lamp operating circuit having an oscillator driving a DC/AC inverter which employs a FET and which in turn energizes an AC/DC converter and voltage multiplier which generates voltage for the flash lamp. The lamp is triggered by a separate circuit.

SUMMARY OF THE INVENTION

It is proposed according to this invention to use power MOSFET devices as the switch elements for an electronic flasher but the limitations of the devices must be considered and a particular flasher design is required to successfully operate as a heavy duty flasher.

It is therefore an object of the invention to provide a heavy duty, high efficiency, electronic flasher. It is a further object to provide such as flasher which is compact and runs relatively cool.

The invention is carried out by a high efficiency high load flasher for incandescent lamps comprising; input terminals for coupling to a DC source and output terminals for coupling to incandescent lamps, MOSFET switch means between the input and output terminals for switchably controlling current flow to the output, gate supply means for supplying gate voltage to the switch means for switch operation, oscillator means for periodically enabling and disabling the gate supply means to effect periodic current flow to the output, and protective means responsive to said current flow for preventing damaging current flow to the MOSFET switch means.

BRIEF DESCRIPTION OF THE DRAWINGS

The above and other advantages of the invention will become more apparent from the following description taken in conjunction with the accompanying drawing wherein the single figure is a schematic circuit of an electronic flasher according to the invention.

DESCRIPTION OF THE PREFERRED EMBODIMENT

The flasher circuit has an input terminal 10 and a metal oxide varistor 12 between the terminal and ground. The varistor 12 absorbs voltage transients from the voltage source. A capacitor 13 between the input terminal and ground provides some filtering. The input terminal 10 is connected to the positive side of a DC voltage source comprising a 12 volt automotive battery and associated vehicle circuits which may vary widely in actual voltage output. An output terminal 14 provides a periodic current flow to the load circuit, not shown, comprising a plurality of incandescent lamps capable of drawing a steady state current of 20 amps with inrush current up to ten times that amount. A switch, not shown, for turning on the lamp operation is located at either the input side or the output side of the flasher circuit.

A pair of n-channel enhancement power MOSFETs 16 connected in parallel connect the input terminal 10 to the output terminal 14. Such devices present a very low resistance when turned on to saturation and also have a high current capacity. Using an IRFZ40 MOSFET as an example, the drain-source resistance is 0.028 ohm and is rated to carry 50 amps continuously. The total voltage drop through the two devices in parallel at a combined 20 amp current level is only 0.28 volts for a total power loss of 5.6 watts or 2.8 watts for a 50% duty cycle. A 100 amp inrush current for each device for 8 to 12 ms is readily handled by the MOSFETs. It is necessary, however, to protect the devices against a dead short from the output terminal 14 to ground. It is also necessary to provide a suitable gate voltage for turning the MOSFETs on.

In general the flasher circuitry includes, in addition to the MOSFETs 16, first and second oscillators comprising timers 18 and 20, each afforded by half of a 556 timer, the timer 18 being configured to produce a flash period of about 800 ms at a 50% duty cycle and the other timer 20 enabled by the timer 18 and configured to oscillate at 125 kHz, a charge pump type voltage multiplier 22 energized by the output of the timer 20 to supply the gate voltage, and an overload protection circuit including a current sensor 24 and a protective device 25. In addition a supply circuit 26 is provided to furnish power to the timers only when a load is present and a transducer 28 coupled to the output terminal 14 furnishes an audible click for each flasher cycle to simulate the sound of an electromechanical flasher.

The supply circuit 26 comprises a resistor 30 and a Darlington pair 32 connected from the input terminal 10 to a timer supply conductor 34. A capacitor 36 and a zener diode 38 are each connected between the conductor 34 and ground and serve, in conjunction with the resistor 30, to provide filtering and voltage regulation. The base of the Darlington pair 32 is connected through a resistor 40 and a diode 42 to the output terminal 14. A capacitor 44 is connected between the input terminal 10 and the junction of the resistor 40 and the diode 42. In operation, the supply circuit 26 allows current flow to the timers 18, 20 when a current load is present. If the switch for actuating the lamps is at the input side of the flasher the input terminal 10 and the output terminal 14 will be at ground potential when the switch is open and the capacitor will be discharged. When the switch is closed the Darlington will conduct initially because of the low voltage on the base due to the capacitor 44 and will continue to conduct during flasher operation because the voltage drop across the MOSFETs 16 will maintain the base voltage lower than the emitter. If the switch is at the output side of the flasher and the switch is open, the terminals will both be at the input voltage and the Darlington will be biased off to prevent operation of the timer circuit and the attendant small power consumption. Actuation of the audible transducer 28 will also be prevented. When the switch is closed the potential at terminal 14 will drop to allow the capacitor 44 to discharge through the diode 42 to bias the Darlington pair into conduction.

The timers 18 and 20 are configured as gated astable square wave oscillators. The frequency of the timer 18 is set by the values of resistors 46 and 48 and the timing capacitor 50 which extends from the trigger input of the timer 18 to ground. The output 52 of the timer 18 alternates between high and low voltage as the timer cycles. The output 52 is applied through a diode 54 to the trigger input of the timer 20 to turn on the timer 20 when the output 52 is at a low voltage and disabling the timer 20 when the output 52 is high. Resistors 56 and 58 and the capacitor 60 set the time constant of the timer 20 to establish a high frequency signal, preferably 125 kHz, at the output 62 of the timer 20.

The voltage multiplier 22 is coupled to the output 62 of the timer 20 and produces a voltage higher than the input voltage at terminal 10 to provide a gate voltage sufficiently high to drive the MOSFETs to saturation. By virtue of the high frequency of the timer 20 small capacitors can be used for the multiplier 22 and moreover, the inherent MOSFET input capacitance serves as the final ripple filtering element in the voltage multiplying chain. The multiplier output is applied to the gate electrodes through series resistors 64 which are employed to eliminate a parasitic oscillation normally related to paralleling devices. A zener diode 66 between the multiplier output and the source electrodes of the MOSFETs 16 regulates the gate voltage to a consistent value.

Overload current sensing with a minimum of power loss is achieved by utilizing the power MOSFETs' varying saturation characteristics with increasing drain current while maintaining a constant gate drive voltage. That is, the power MOSFET is somewhat current limiting thereby affording a safety feature. This characteristic also protects the MOSFETs from destruction by a momentary dead shorted output connection. The high current does however, dissipate sufficient energy in the device that destruction would occur if allowed to continue. Thus the overload current sensor 24 is provided to detect an undesirably high current and to trigger a protective device 25 to abort the flasher pulse. The sensor 24 has a transistor 68 with its emitter connected through a resistor 70 to the MOSFET drain and its base connected through a resistor 72 to the source. The value of the resistor 72 determines the response of the transistor 68 to a given load current level. The base-emitter voltage of the transistor varies with temperature. To compensate for that temperature effect, an identical transistor current mirror is provided. For that purpose a transistor 74 has its emitter connected to the emitter of the transistor 68 and its base and collector both connected to the base of transistor 68.

The sensor transistor 68 is biased on when a current overload causes a high voltage drop across the MOSFETs. The transistor 68 is also on during the MOSFET off cycle. The transistor 68 serves as a current source to charge a delay capacitor 76 through a gating transistor 78. The gating transistor 78 is biased on by the low output 52 when the MOSFETs 16 are conducting and is biased off when they are not conducting to prevent the output of sensing transistor 68 during that period from affecting the timer operation. The collector of the sensing transistor 68 is clamped to five volts by a zener diode 80 connected between the collector and ground. The delay capacitor 76 is referenced to ground and its positive plate is coupled through a resistor 82 to the base of the protective device 25 which is a transistor with its emitter and collector connected across the timing capacitor 50. When the delay capacitor 76 voltage reaches a value sufficient to turn on the device 25 the latter discharges the timing capacitor 50 thus aborting the on time period generated by the flash rate oscillator and consequently turning off the power switches. This cycle repeats as long as the overload condition remains. A stabilizing capacitor 86 coupled from the output 52 to the timer trigger input stabilizes the current limiting circuit loop, when it is activated. The charging period of the capacitor 76 provides a time delay of about 10 ms so that the usual inrush current at the beginning of each cycle will not trigger the protective device 25. Due to the characteristics of the MOSFETs a high current of that brief duration, even in the case of a shorted output, would not harm the MOSFETs.

A flasher according to the above description is very conservative in its use of energy. Only small amounts are dissipated so that large bulky heat sinks or special packaging are not required. Rather, the heat produced is so small that a small surface area is sufficient to dissipate the heat and in addition the electronic components are also small and easily fit into a compact housing.

It will be apparent that the high efficiency flasher according to the invention will manage heavy incandescent lamp loads subject to overloading with only minimal energy dissipation and requiring only a small package. It will further be apparent that the flasher mimics the conventional electromechanical flasher and yet has a longer life.

The embodiments of the invention in which an exclusive property or privilege is claimed are defined as follows:

1. A high effciency high load flasher for incandescent lamps comprising;

input terminals for coupling to a DC source and output terminals for coupling to incandescent lamps, MOSFET switch means between the input and output terminals for switchably controlling output current flow, gate supply means for supplying gate voltage to the switch means for switch operation, oscillator means for periodically enabling and disabling the gate supply means to effect periodic output current flow, protective means responsive to said current flow for preventing damaging current flow to the MOSFET switch means, and measn for disabling the protective means during current inrush to the incandescent lamps.

2. The invention as defined in claim 1 wherein the MOSFET switch means includes a plurality of MOSFETs in parallel.

3. The invention as defined in claim 1 wherein the MOSFET switch means includes an n-channel enhancement power MOSFET and the gate supply means includes a second oscillator means for producing a high frequency output, and a voltage multiplier energized by the high frequency output to yield a gate voltage higher than the DC source voltage.

4. The invention as defined in claim 1 wherein the gate supply means includes means for regulating the gate voltage to provide a predictable MOSFET characteristic, and wherein the protective means senses the drain-source voltage to detect the current flow and includes means responsive to such voltage for terminating current flow when excessive current is detected to thereby prevent continuous current at excessive rates.

5. The invention as defined in claim 4 wherein the gate supply means includes a second oscillator means for producing a high frequency output, a voltage multiplier subject to the output to yield a gate voltage higher than the DC source voltage and means for regulating the gate voltage to a consistent value.

6. The invention as defined in claim 4 wherein said means for disabling the protective means comprises time delay means for disabling the protective means at the beginning of each current flow period to allow current inrush to the incandescent lamps.

7. The invention as defined in claim 1 including means for supplying power from the input terminals to the oscillator means, such supplying means including a transistor switch responsive to the load on the output terminals for terminating power to the oscillator means in the absence of the load.

* * * * *